US005091105A

United States Patent [19]

Madore et al.

[11] Patent Number: 5,091,105

[45] Date of Patent: Feb. 25, 1992

[54] LIQUID DETERGENT FABRIC SOFTENING LAUNDERING COMPOSITION

[75] Inventors: Linda M. Madore, Midland, Mich.; Annemieke C. M. Donkers, Le Cap Vert-Les Vigies, France

[73] Assignee: Dow Corning Corporation, Midland, Mich.

[21] Appl. No.: 637,843

[22] Filed: Jan. 7, 1991

Related U.S. Application Data

[63] Continuation-in-part of Ser. No. 419,181, Oct. 10, 1989.

[51] Int. Cl.[5] ..... C11D 17/00; C11D 7/32; D06M 10/08

[52] U.S. Cl. ..... 252/174; 252/8.6; 252/8.7; 252/8.75; 252/8.8; 252/8.9; 252/173; 252/174.15; 252/544; 252/547

[58] Field of Search ..... 252/8.6, 8.8, 173, 174.15, 252/544, 547, 8.7, 8.75, 8.9, 174

[56] References Cited

U.S. PATENT DOCUMENTS

| | | | |
|---|---|---|---|
| 4,419,391 | 12/1983 | Tanaka et al. | 252/8.8 |
| 4,541,936 | 9/1985 | Ona et al. | 252/174.15 |
| 4,585,563 | 4/1986 | Busch et al. | 252/8.8 |
| 4,639,321 | 1/1987 | Barrat et al. | 252/8.8 |
| 4,685,930 | 8/1987 | Kasprzak | 252/8.8 |
| 4,708,807 | 11/1987 | Kemerer | 252/8.6 |
| 4,846,982 | 7/1989 | Madore et al. | 252/8.6 |
| 4,908,140 | 3/1990 | Bausch et al. | 252/8.6 |

FOREIGN PATENT DOCUMENTS 1549180 7/1975 United Kingdom .

OTHER PUBLICATIONS

"Chemistry and Technology of Silicones", Walter Noll, Academic Press Inc. (1968), pp. 386–392.

*Primary Examiner*—A. Lionel Clingman
*Assistant Examiner*—William S. Parks
*Attorney, Agent, or Firm*—Jim L. DeCesare

[57] ABSTRACT

A liquid detergent having fabric softening properties and including an improved fabric softening agent. The fabric softening agent is a silicone fabric softening agent which is free of aminosubstitution selected from the group consisting of a polyorganosiloxane which is free of reactive organic functional groups and having a viscosity in excess of about 5,000 centistrokes measured at twenty-five degrees Centigrade; a polydiorganosiloxane gum having a viscosity of about two million centistrokes; or a mixture of the said gum with either a low viscosity polydiorganosiloxane or with a volatile cyclic silicone such as octamethylcyclotetra-siloxane or decamethylcyclopentasiloxane. Certain emulsions of a highly branched and cross-linked silicone polymer may also be employed.

7 Claims, No Drawings

LIQUID DETERGENT FABRIC SOFTENING LAUNDERING COMPOSITION

RELATED PATENT APPLICATIONS

This application is a continuation-in-part of our prior copending application U.S. Ser. No. 07/419,181 filed Oct. 10, 1989.

BACKGROUND OF THE INVENTION

This invention relates to a fabric softening agent and to a liquid detergent laundering product including the softener. The detergent contains one or more anionic, nonionic, and cationic surfactants.

Solid detergent formulations are sold in powder or granular form. A disadvantage of solid detergents is that, on account of the hygroscopicity of individual raw materials of the formulation, the solid detergent shows a pronounced tendency towards caking or clumping in the presence of small quantities of moisture. This does not make the detergent unusable, however, because the effect of the individual components of the detergent remain intact even after clumping or caking in the presence of moisture. However, the appearance of the detergent in most cases is diminished. As a result, there has been a desire to develop liquid detergent compositions for convenience in lieu of conventionally formulated solid detergent compositions. The liquid detergent allows for use of lower washing temperatures inclusive of cold water laundering. Granular detergents have not fully adapted to such varitions because of weaknesses in respect of dissolving speed, insolubility, and cleaning efficiency. Due to such problems of caking and the slowness of solid and granular detergents to dissolve, trends in detergent manufacture have leaned toward the liquid detergent. Such detergents usually include one or more anionic, nonionic, and cationic organic surfactants, water, brightening agents, hydrotropes, enzymes, soil suspending agents, bleaches, pH modifiers, and solvents. It is not uncommon to also include an antifoam or defoamer formulation as a part of the detergent package. Such systems may be built or free of builders.

A fabric softener often contains a dilute solution or dispersion of a quaternary ammonium derivative used to treat fabrics in the final rinse of a laundering process in order to make the fabrics feel softer. In addition to softness, fabric softeners are known to also provide static control. Because of the affinity of quaternary ammonium compounds for negatively charged surfaces, their single largest market has been as fabric softeners. Commercial fabric softeners generally include about a four to eight percent dispersion of quaternary ammonium compound which is added to the rinse cycle of the washing process. In some cases, a fatty acid stearate is added to modify the handle. The quaternary ammonium compound can also be applied to a nonwoven sheet or a polyurethane foam which is added with wet clothes in a dryer. Such sheets contain a fatty amine or a fatty acid ester which allows the quaternary ammonium compound to transfer from the sheet to the clothes in the dryer during the drying cycle. Recently, there have been devised combined detergent and softener formulations which allow introduction of all additives in the wash cycle.

A basic distinction should be drawn between a rinse cycle softener and a wash cycle softener. As noted hereinabove, the rinse cycle fabric softener is a liquid dispersion of a quaternary ammonium compound which is added separately to the rinse liquor during the rinse cycle of the laundering device. A wash cycle fabric softener on the other hand typically contains the quaternary ammonium compound which is mixed in with the laundry detergent and added to the wash liquor by the homemaker, for example, before initiation of the wash cycle of the fabric laundering device. Wash cycle softeners often also include mixtures of quanternary ammonium compounds, clays, and amines.

The present invention relates to this latter category of softener, or specifically to a liquid wash cycle softening detergent. Liquid detergents containing silicone fabric softening agents are not new as exemplified by U.S. Pat. No. 4,639,321, issued Jan. 27, 1987. The '321 patent describes a liquid detergent having through-the-wash softening benefits comparable to the softening obtained with cationic rinse cycle softener formulations. In addition to anionic and nonionic surfactants, and a carrier, this softening liquid detergent is said to contain an aminosubstituted polydialkysiloxane as the softening agent. However, such aminofunctional siloxanes suffer from the disadvantage in that such compounds tend to yellow fabrics.

In an effort to avoid this disadvantage of the aminofunctional type materials of the prior art, the present invention is directed to a liquid detergent having fabric softening properties and including a particular category of polyorganosiloxane which is free of reactive functional groups. However, because polydimethylsiloxane is very insoluble in water, it is difficult to produce stable products containing these materials such as required in liquid detergent systems. This is for the reason that the polydimethylsiloxane molecule does not include hydrophilic groups which would render the molecule more compatible in typical liquid detergent formulations. Nevertheless, surprisingly it has been discovered that by properly emulsifying these reactive free silicones in a detergent matrix, that the polydimethylsiloxane can be rendered compatible in a liquid detergent system. This is significant since polydimethylsiloxanes are not known to possess the characteristic yellowing property of aminofunctional polyorganolsiloxanes. Thus, and in accordance with the concepts of the herein described invention, there is set forth a new and novel liquid detergent having fabric softening and cleaning properties and which contains as the softening agent a non-yellowing type of silicone.

SUMMARY OF THE INVENTION

This invention relates to a liquid detergent having fabric softening properties and including at least one fabric softening agent. The improvement involves the use of a silicone fabric softening agent selected from the group consisting of a polyorganosiloxane which is free of reactive organic functional groups and having a viscosity in excess of about 5,000 centistokes measured at twenty-five degrees Centigrade; a polydiorganosiloxane gum having a viscosity in excess of about two million centistokes; or a mixture of at least one volatile cyclic silicone and a polydiorganosiloxane gum as defined above.

In some of the more preferred embodiments of the present invention, the volatile cyclic silicone constitutes about 70–95 percent by weight based on the total weight of the silicone mixture. The volatile cyclic silicone must be sufficiently volatile to evaporate at room temperature, and exemplary materials are octamethylcyclotetrasiloxane, decamethylcyclopentasiloxane, or mixtures thereof.

The detergent includes a carrier fluid such as water, ethanol, isopropanol, butanol, hexanol, or diethylene glycol. The detergent also includes at least one anionic surfactant, and at least one nonionic surfactant. A cationic surfactant may also be included. The ratio between the anionic surfactant and the nonionic surfactant is 4:1 to 1:4, more preferably from about one to one to about three to one.

The detergent should include on a weight basis at least about 0.5–5.0 percent of the silicone fabric softening agent. The detergent is employed in an amount of about 0.05–0.3 percent by weight based on the weight of fabrics being treated. The polydimethylsiloxane fluid found to be most effective for the purposes of the present invention is a polyorganosiloxane which is free of reactive organic functional groups, the polydimethylsiloxane having a viscosity of from about 12,000 to about thirty thousand centistokes.

These and other features, objects, and advantages, of the herein described invention will become more apparent when considered in light of the following detailed description thereof.

DETAILED DESCRIPTION

While the liquid detergent of the present invention may contain many of the commonly included ingredients such as surfactants, builders, enzymes and enzyme stabilizers, pH modifiers, bleach activators and bleaches, antifoams, anti-redeposition agents, chelants, soil release polymers, dye transfer protectants, zeolite dispersants, water softeners, perfumes, anti-oxidants, and fluorescent brighteners, the essential ingredients for purposes of the present invention are an anionic surfactant, a nonionic surfactant, a carrier fluid, and the softening agent.

Water is a suitable carrier although other fluids such as ethanol, isopropanol, butanol, hexanol, and diethylene glycol, may be employed.

The softening agent as noted above, is a silicone and may include at least one of a polydimethylsiloxane having a viscosity greater than about 5,000 centistokes as measured at twenty-five degrees Centigrade, a polydiorganosiloxane gum having a viscosity of the order of about two million centistokes, or an admixture of a polydiorganosiloxane gum as previously indicated together with about 70–95 percent by weight of a volatile cyclic silicone. These materials will be described in detail hereinafter.

The liquid detergent contains at least one surfactant and the surfactants preferred for purposes of the present invention are the nonionic and anionic surfactant type. In nonionic surfactants, for example, there is no charge on the molecule, and the solubilizing groups are ethylene oxide chains and hydroxyl groups. Such nonionic surfactants are compatible with ionic and amphoteric surfactants, and representative of nonionic surfactants are, for example, polyoxyethylene or ethoxylate surfactants such as alcohol ethoxylates and alkylphenol ethoxylates. Carboxylic acid ester nonionic surfactants include glycerol esters, polyoxyethylene esters, anhydrosorbitol esters, ethoxylated anhydrosorbitol esters, natural fats, oils, and waxes, and ethoxylated and glycol esters of fatty acids. Carboxylic amide nonionic surfactants which may be included are diethanolamine condensates, monoalkanolamine condensates, and polyoxyethylene fatty acid amide. Representative of polyalkylene oxide block copolymer nonionic surfactants are the polyalkylene oxides derived from ethylene, propylene, butylene, styrene, and cyclohexene. Typical of the anionic surfactants that may be employed herein are salts of alkyl sulfates, salts of alkylaryl sulfates, salts of alkyl ether sulfates, salts of alkylaryl ether sulfates, and salts of alkylaryl sulfonates. Exemplary materials included are, for example, alkyl benzene sulfonates, alkyl glyceryl ether sulfonates, alkyl phenol ethylene oxide ether sulfates, esters of alpha-sulfonated fatty acids, 2-acyloxyalkane-1-sulfonic acids, olefin sulfonates, beta-alkyloxyalkane sulfonates, anionic surfactants based on higher fatty acids, and tallow range alkyl sulfates. Both categories of surfactant are well known in the art and are described in more or less detail in U.S. Pat. No. 4,075,118, issued Feb. 21, 1978, for example. Conventional cationic surfactants may also be included, if desired.

The term silicone denotes a polymer of the formula $$(R_nSiO_{\frac{4-n}{2}})_m$$

wherein n is an integer between zero and three, and m is two or more. The simplest silicone materials are the polydimethylsiloxanes. Polydimethylsiloxanes have the structure

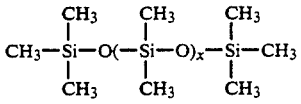

where x is an integer of from one to about one hundred thousand. The repeating unit of the polymer Me
SiO
Me is the dimethylsiloxane unit. The terminal unit (Me3SiO) is the trimethylsiloxy group, however, the polymer may be hydroxy or methoxy endblocked. At low molecular weights, silicones are fluids, and at high molecular weights, they are gums which may be cross-linked to form elastomeric products. The methyl group in a silicone may be substituted by a variety of other substituents including for example, phenyl, vinyl, and hydrogen. Conventional silicones are the trimethylsiloxy, hydroxy, or methoxy terminated polydimethylsiloxanes. Such materials are available in viscosities ranging from 0.65 to 2,500,000 centistokes. Substituents on the silicon consist of methyl groups or oxygen. Termination of the polymer chain prevents viscosity change and other alterations of the physical properties of the silicone polymeric materials. The polydimethylsiloxanes exhibit characteristic properties of low viscosity change with temperature; thermal stability; oxidative stability; chemical inertness; non-flammability; low surface tension; high compressibility; shear stability; and dielectric stability. In resin forming polysiloxanes, some of the methyl groups are hydrolyzable and permit the formation of Si—O—Si cross-links upon heating in the presence of a catalyst, but in the organosilcon fluids and oils, substantially all of the methyl groups are non-hydrolyzable and the fluid is heat stable.

The polydimethylsiloxane fluid used herein as the softening agent is a high molecular weight polymer having a viscosity in the range from about 350 to 2,000,000 centistokes, preferably from about 5,000 to 50,000 centistokes at 25° C. The siloxane polymer is generally end-blocked either with trimethylsilyl, hydroxyl, or methoxy groups but other end-blocking groups are also suitable. The polymer can be prepared by various techniques such as the hydrolysis and subsequent condensation of dimethyldihalosilanes, or by the cracking and subsequent condensation of dimethylcyclosiloxanes.

The polydiorganosiloxane gum suitable for use in the present invention are for the most part polydimethylsiloxane gums. The polydiorganosiloxane gums can be represented by an average unit formula $$R_a^3SiO_{\frac{4-a}{2}}$$

where each $R^3$ is a methyl radical, a vinyl radical, a phenyl radical, an ethyl radical or a 3,3,3-trifluoropropyl radical and a has an average value of 1.95 to 2.005 inclusive. Since the polydiorganosiloxane gums are essentially polydimethylsiloxane gums, at least 90 percent of the total $R^3$ groups are methyl radicals and the remaining $R_3$ groups are vinyl, phenyl, ethyl of 3,3,3-trifluoropropyl. Small amounts of other groups can be present such as 1 or 2 percent of the total $R_3$, where such groups are other monovalent hydrocarbon groups, such as propyl, butyl, hexyl cyclohexyl, beta-phenylethyl, octadecyl and the like; other halogenated monovalent hydrocarbon radicals, such as chloromethyl, bromophenyl, $\alpha,\alpha,\alpha$-trifluorotolyl, perfluoroheptylethyl, dichlorophenyl and the like; cyanoalkyl; alkoxyl, such as, methoxy, propoxy, ethoxy, hexoxy and the like; ketoxime; halogen; hydroxyl; and acyloxy. The groups which are present in small amounts are considered as incidental and not producing any significant characteristic changes of the polydimethylsiloxane gum.

The polydiorganosiloxane gums suitable for the present invention are essentially composed of dimethylsiloxane units with the other units being represented by monomethylsiloxane, trimethylsiloxane, methylvinylsiloxane, methylethylsiloxane, diethylsiloxane, methylphenylsiloxane, diphenylsiloxane, ethylphenylsiloxane, vinylethylsiloxane, phenylvinylsiloxane, 3,3,3-trifluoropropylmethylsiloxane, dimethylphenylsiloxane, methylphenylvinylsiloxane, dimethylethylsiloxane, 3,3,3-trifluoropropyldimethylsiloxane, mono-3,3,3-trifluoropropylsiloxane, monophenylsiloxane, monovinylsiloxane and the like.

The polydiorganosiloxane gums are well known in the art and can be obtained commercially, and are considered to be insoluble polydiorganosiloxanes which have viscosities greater than 1,000,000 cs. at 25° C., preferably greater than 5,000,000 cs. at 25° C.

These gums may be used alone as well as in admixture with one or more volatile ingredients such as a cyclic silicone. Volatile cyclic silicones which may be employed are polydimethylcyclosiloxanes exemplary of which are octamethylcyclotetrasiloxane and decamethylcyclopentasiloxane. The viscosity at 25° C. of the volatile cyclics is generally of the order of 2.5 to 6.0 cs. Such volatile ingredients are generally represented by the formula $(CH_3)_2SiO_x$ where x is 3–8. When used in admixture with the gum, the level of the gum is generally of the order of about thirteen percent by weight.

The following examples are set forth in order to illustrate the concepts of the present invention.

EXAMPLE I

In accordance with the present invention, silicones were emulsified in a detergent matrix by first mixing the silicone with the acid form of an anionic surfactant such as a linear alkyl benzene sulfonic acid. The mixture of the anionic surfactant and the silicone was neutralized by the addition of a base such as sodium hydroxide in a mixture of water and ethanol. The salt of the anionic surfactant results from this neutralization. Following completion of the neutralization, the nonionic surfactant was added, together with other optional ingredients such as builders, fatty acids, cationic surfactants, and optical brighteners. The mixture was mechanically agitated in order to insure a homogeneous product. It has been found that in the event that the foregoing procedure is not followed, that the silicone ingredient is caused to separate thus forming an unstable product. This occurs, for example, by the addition of the silicone to a random mixture of various ingredients as in the procedures of U.S. Pat. No. 4,639,321, where in the examples, an amino-substituted silicone is admixed directly into a liquid composition of some fourteen ingredients under agitation. In accordance with the present invention, the silicone must be first mixed with an anionic surfactant and neutralized prior to being added to the balance of the liquid detergent formulation in order to provide a stable end product.

The above procedure was followed and several formulations of liquid detergent containing a silicone softening agent were prepared. In each instance there was employed twenty weight percent of an anionic surfactant, six weight percent of a nonionic surfactant, five weight percent of ethanol, three weight percent of a silicone softening agent, and the balance being water. The preferred ratio between the anionic surfactant and the nonionic surfactant is 1:1 to 3:1. The anionic surfactant employed was an alkylbenzene sulfonic acid of Vista Chemical Company. The nonionic surfactant was NEODOL® 25-7, a trademark and product of Shell Chemical Company, Houston, Tex., and a linear primary alcohol. Liquid detergents were prepared containing these ingredients and including one of three silicone softening agents, namely, a polydimethylsiloxane fluid of a viscosity in excess of 5,000 centistokes; a polydiorganosiloxane gum having a viscosity of about two million; and a mixture of a polydiorganosiloxane gum having a viscosity of about two million and about 70–95 weight percent of a volatile cyclic silicone of octamethylcyclotetrasiloxane and decamethylcyclopentasiloxane.

EXAMPLE II

Towels were prepared for treatment by removing the mill textile conditioners applied at the mill during manufacture of the towels. The process was conducted at a commercial laundromat. Bundles of 86:14 cotton polyester terry towels were washed five times with an anionic detergent containing a high level of phosphorus. Detergent remaining in the towels was removed by three final wash and rinse cycles from which detergent was omitted. Each bundle was subjected to eight complete wash and rinse cycles during the stripping process followed by a drying cycle.

The test used to measure softness was a panel test in which fifteen people were asked to rank several towels in order of softness. Following treatment, the towels were placed in a constant temperature and humidity room over night to equilibriate, and after which the towels were tested the next day. Dryers tend to overdry towels and provide a harsher feel than normal, and therefore all towels tested in a given panel were conditioned at the same temperature and humidity before testing. Each test included one control towel. The control towel was a towel which had not been treated by a liquid detergent containing a softening agent. The fifteen people were asked to evaluate the towels by feeling the towels and choosing the harshest towel, the softest towel and placing the remaining towels in order of increasing softness. The towels were assigned a ranking between one and five with the highest value corresponding to the softest towel. Before the test was conducted, each member of the panel was asked to wash their hands to remove any residue which might interfere with the test. During the evaluation, the panel members rewashed their hands to remove any softener buildup. Since the softness of a towel increases with repeated handling, a new surface of each towel was exposed for each panel member, and each towel was replaced after evaluation by three people.

EXAMPLE III

Each of the liquid laundry detergents containing a silicone softening agent as prepared in accordance with Example I was used to treat a fabric bundle which had been conditioned in accordance with the procedure of Example II. The bundles contained six towels and weighed about 1200–1400 grams. The bundle was loaded into a washing machine and about fifty grams of liquid detergent containing a softening agent was added to the washing machine. The washing machine controls were established to provide a warm water wash (35° C.) and a cold water rinse. The duration of the wash cycle of the particular washing machine employed was about fourteen minutes. At the end of the cycle of the washing machine, the bundle was dried in a dryer for about one hour. Each bundle was exposed to two complete cycles including washing and drying. The bundles were then equilibriated and tested to measure softness as indicated in Example II.

The results of the softness test are set forth in Table I hereinbelow. In addition to the silicone softening agents of the present invention, there was also tested softening agents of the prior art for comparative purposes. One softening agent was a commercially employed organic fabric softening agent and a product of Sherex Chemical Company, Dublin, Ohio. The organic softening agent was monohydrogenated tallow trimethylammonium chloride available as a fifty percent by weight active material in isopropanol solvent. This organic softening agent is marketed under the trademark ADOGEN® 441. The other softening agent tested for comparative purposes is shown in Table II and was an aminofunctional silicone similar to the compound identified as "Sil-II" in U.S. Pat. No. 4,639,321. Both of the comparative softening agents were employed in the same amount to treat the fabric bundles as the silicone softening agents of the present invention, namely, about 0.12 weight percent of active ingredient based on the weight of the bundle. The amount of the softening agent employed may vary from 50–100 grams per load depending upon the particular weight of the bundle being treated.

TABLE I

| Softening Agent | Average Rank |
|---|---|
| Polydimethylsiloxane, viscosity of about 30,000 centistokes | 4.0 |
| Polydiorganosiloxane gum, viscosity of about two million centistokes | 3.2 |
| Mixture of volatile cyclic silicone and polydiorganosiloxane gum | 3.1 |
| Polydimethylsiloxane, viscosity of about 12,500 centistokes | 3.0 |
| ADOGEN® 441 | 2.8 |
| Control | 1.9 |

Table I indicates that the four silicone softening agents of the present invention attained an average rank of at least three or more, well above the rank attained by the prior art organic softening agents represented by the material indicated above.

In addition to the silicone softening agents shown above in Table I, certain branched and cross-linked silicone polymers may also be employed herein.

The branched and crosslinked silicone polymers and methods for their preparation are described in more or less detail in U.S. Pat. No. 2,891,920, issued June 23, 1959, the disclosure of which is incorporated herein by reference. These materials can be any organosiloxane of the formula:

$$R_nSiO_{\frac{4-n}{2}}$$

in which R is selected from the group consisting of monovalent hydrocarbon radicals, halogenated monovalent hydrocarbon radicals, and hydrogen atoms; and in which n is an integer having an average value of from one to less than three. However, for purposes of illustration, a procedure for the preparation of a representative branched and crosslinked silicone polymer of the present invention is set forth in the following examples.

EXAMPLE IV 88 grams of a 27% water solution of tallow trimethyl ammonium chloride was added to 535 grams of water until a uniform mixture was obtained. To this mixture was added 350 grams of octamethylcyclotetrasiloxane and 6.5 grams of methyl trimethoxysilane followed by vigorous stirring. The resulting emulsion was passed twice through a homogenizer set at 7500 psig. The emulsion was then made alkaline by the addition of 1 gram of a 50% sodium hydroxide solution. The emulsion was heated at 85 degrees Centigrade for 9 hours. After cooling to 40 degrees Centigrade, 1.5 grams of 85% phosphoric acid was added and stirred for 5 minutes followed by the addition of 17 grams of MAKON® 10, a nonyl phenoxy-polyethylene oxide surfactant. The emulsion was allowed to stir for 1 hour at 40 degrees Centigrade. Upon cooling to room temperature 0.5 grams of KATHON® CG/ICP, a preservative, was added.

Whereas Example IV is specific to methyl trimethoxysilane, branching may also be obtained with materials such as $(CH_3O)_3Si(CH_2)_3NHCH_2CH_2NH_2$ and $(CH_3O)_3Si(CH_2)_3N^{\oplus}(CH_3)_2(CH_2)_{17}CH_3Cl^{\ominus}$ Compositions prepared in accordance with Example IV, when tested in accordance with the procedures of Example III, yielded date shown in Table II.

Generically, the branched and crosslinked siloxanes set forth in the foregoing examples are of the general formula:

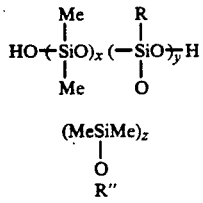

wherein:

Me is methyl;

x and z have values of 3 to 100,000;

y has a value of 1 to 10,000;

R is $(CH_2)_nZ$;

R'' is hydrogen or

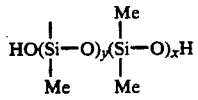

n has a value of 1 to 10;

Z is

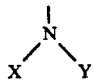

whereby X and Y are selected independently, —H; —$C_{1-30}$-alkyl; —$C_6$-aryl; —$C_{5-6}$-cycloalkyl; —$C_{1-6}$—$NH_2$; —CO—R'; with the proviso that the nitrogen can be quaternized such as to represent

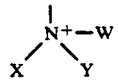

whereby W can be selected from X or Y; or Z is

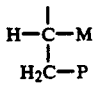

whereby P and M are —COOH; —CO—$NR'_2$; or $C_{1-2}$-alkyl; where $R'=C_{1-4}$ alkyl. Z can also be hydrogen.

Branched and crosslinked silicone polymers can also be produced by emulsion polymerization of the previously described gums using water as solvent.

EXAMPLE V

Example III was repeated and additional results are set forth in Table II.

TABLE II

| Softening Agent | Average Rank | |
|---|---|---|
| | First Treatment | Third Treatment |
| Polydimethylsiloxane, Viscosity of About 12,500 Cst. | 4.42 | 4.54 |
| High Molecular Weight Amino-substituted Siloxane | 2.83 | 2.76 |
| Low Molecular Weight Amino-Substituted Siloxane | 2.67 | 2.54 |
| Highly Branched Polydimethyl Siloxane | 2.42 | 2.15 |
| ADOGEN ® 441 | 2.67 | 3.07 |

Table II indicates polydimethylsiloxane of about 12,500 Cst. provides a significantly higher average softness rank over three complete treatment cycles than materials of the prior art. The highly branched polydimethylsiloxane provides equivalent softness without the disadvantage of discoloration or yellowing of fabrics. It should be noted that the gum may also be employed in the form of a mixture including a low viscosity polydiorganosiloxane of a viscosity of about one hundred centistokes.

In the present invention, various categories of silicones have been referred to hereinabove such as cyclic siloxanes, low viscosity siloxanes, high viscosity siloxane fluids, siloxane gums, and branched siloxanes. These silicones are each clearly distinguishable materials one from the other. For example, a simple test exists which is based on the varying solubilities of these materials in isopropanol and toluene. Thus, cyclic siloxanes are soluble in both isopropanol and toluene. Low viscosity siloxanes, that is siloxanes having a viscosity less than about one thousand centistokes, are also soluble in toluene but not in isopropanol. Similarly, siloxane gums are insoluble in isopropanol but soluble in toluene. The branched siloxanes are neither soluble in isopropanol nor toluene.

It will be apparent from the foregoing that many other variations and modifications may be made in the compounds, compositions, and methods described herein without departing substantially from the essential features and concepts of the present invention. Accordingly, it should be clearly understood that the forms of the invention described herein are exemplary only and are not intended as limitations on the scope of the present invention.

That which is claimed is:

1. In a liquid laundry detergent free from silicones containing amino substituents having fabric softening properties the improvement comprising a silicone fabric softening agent which is a hydrophobic cationic emulsion of a silicone polymer having a general formula:

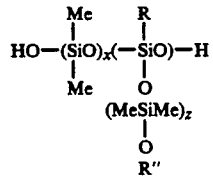

wherein:

Me is methyl x and z have values of 3 to 100,000;

y has a value of 1 to 10,000;

R is $(CH_2)_nZ$; Z is hydrogen;

R'' is a hydrogen or

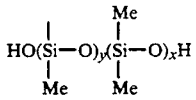

n has a value of 1 to 10.

2. The detergent in accordance with claim 1 including a carrier fluid selected from the group consisting of water, ethanol, isopropanol, butanol, hexanol, propylene glycol, and diethylene glycol.

3. The detergent in accordance with claim 1 in which the detergent includes at least one surfactant selected from the group consisting of anionic, nonionic, and cationic surfactants.

4. The detergent in accordance with claim 3 in which the ratio between the anionic surfactant and the nonionic surfactant is from about one to one to from about three to one.

5. The detergent in accordance with claim 3 in which the detergent includes on a weight basis about 0.5 to 5.0 percent of the silicone fabric softening agent.

6. The detergent in accordance with claim 5 in which the detergent is employed in an amount of about 0.05–0.3 percent by weight based on the weight of fabrics being treated.

7. In a method of treating fabrics in the wash cycle of a laundering process employing a detergent free from silicones containing amino substituents having through-the-wash softening benefits the improvement comprising utilizing as the silicone ingredient a silicone fabric softening agent selected from the group consisting of (i) a polydiorganosiloxane gum having an average unit formula $$R_aSiO_{\frac{4-a}{2}}$$

wherein each R is a monovalent radical selected from the group consisting of a methyl radical, a vinyl radical, a phenyl radical, an ethyl radical and a 3,3,3-trifluoropropyl radical, and a has an average value of 1.95 to 2.005 inclusive, at least 90 percent of the total R groups being methyl radicals, and molecules of said polydiorganosiloxane gum being terminated by a group selected from the group consisting of silanols, alkoxys and $R_3SiO_{0.5}$ where R is defined above; (ii) a mixture of at least one volatile cyclic silicone and a polydiorganosiloxane gum as defined above; (iii) a mixture of a gum as defined above and a low viscosity polydiorganosiloxane; and (iv) a hydrophobic cationic emulsion of a silicone polymer having the formula

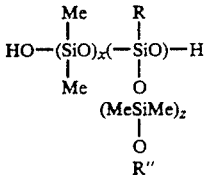

wherein

Me is methyl;

x and z have values of 3 to 100,000;

y has a value of 1 to 10,000;

R is $(CH_2)_nZ$; Z is hydrogen;

R″ is hydrogen or

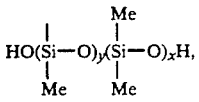

and n has a value of 1 to 10.

* * * * *